US010799027B1

(12) United States Patent
Miller

(10) Patent No.: US 10,799,027 B1
(45) Date of Patent: Oct. 13, 2020

(54) CONVERTIBLE SEAT FOR ACHIEVING A SEATING MODE AND A BABY CARE MODE

(71) Applicant: Caroline Miller, New York, NY (US)

(72) Inventor: Caroline Miller, New York, NY (US)

( * ) Notice: Subject to any disclaimer, the term of this patent is extended or adjusted under 35 U.S.C. 154(b) by 0 days.

(21) Appl. No.: 16/595,483

(22) Filed: Oct. 8, 2019

Related U.S. Application Data

(60) Provisional application No. 62/742,940, filed on Oct. 9, 2018.

(51) Int. Cl.
*A47C 1/14* (2006.01)
*A47D 15/00* (2006.01)

(52) U.S. Cl.
CPC ..... *A47C 1/146* (2013.01); *A47D 15/003* (2013.01)

(58) Field of Classification Search
CPC ..... A47D 15/003; A47C 1/146; A47C 7/622; A47C 13/00
USPC ..... 297/188.07, 380
See application file for complete search history.

(56) References Cited

U.S. PATENT DOCUMENTS 3,635,521 A 1/1972 Shivvers
4,824,171 A * 4/1989 Hollingsworth ..... A47C 1/146 297/351
6,007,572 A * 12/1999 Baldwin ..... A47C 7/021 607/114
D449,947 S * 11/2001 Schoefer ..... D6/368
6,981,741 B2 1/2006 Sirjoo
7,500,278 B2 3/2009 Leach
7,748,582 B2 * 7/2010 Hayden ..... A47C 4/52 224/153
9,032,572 B1 * 5/2015 Leach ..... A47D 15/003 5/655
2004/0177446 A1 * 9/2004 Robb ..... A47D 15/003 5/655
2005/0056668 A1 * 3/2005 Aris ..... A45C 9/00 224/153
2009/0090751 A1 * 4/2009 D'Alessandro ..... A45F 4/02 224/155
2009/0178204 A1 7/2009 Sager
2014/0049087 A1 2/2014 Kinczkowski
2017/0303652 A1 * 10/2017 Tate ..... A45C 3/00
2018/0146794 A1 5/2018 Torres

* cited by examiner

*Primary Examiner* — Milton Nelson, Jr.
(74) *Attorney, Agent, or Firm* — Kanika Radhakrishnan; Evergreen Valley Law Group

(57) ABSTRACT

The present disclosure provides a convertible seat. The convertible seat includes a seat member and a backrest member pivotally mounted to seat member. The backrest member is configured to at least assume a folded position, a first unfolded position and a second unfolded position. The first unfolded position is a seat mode and second unfolded position is a diaper changing position. The backrest member in seat mode is inclined relative to seat member to enable an adult accompanying an infant to sit and the backrest member in the diaper changing station mode is aligned with a longitudinal plane of the seat member to enable an infant to rest for replacement of a diaper. The convertible seat further includes a plurality of storage compartment, which is configured with a sterile surface. The compartment when laid-out in diaper changing station mode allows infant to rest on sterile surface for replacement of diaper.

20 Claims, 11 Drawing Sheets

CONVERTIBLE SEAT FOR ACHIEVING A SEATING MODE AND A BABY CARE MODE

TECHNICAL FIELD

The present disclosure relates to a convertible seat and, more particularly relates to, a convertible seat defined with a plurality of storage compartments for storing items and configured to be placed on the ground for use as a sterile diaper changing station.

BACKGROUND

Portable seats are generally known in the art for use in areas such as but not limited to concerts, stadiums, campsites and the like, where it may be required for a user to be seated on a floor or on bleachers. If the user is carrying an infant/toddler, it may be even more uncomfortable sitting on the floor due to lack of a support structure or uneven surfaces of the floor. The portable seats are adapted to provide lumbar and/or butt support to the user during use, to mitigate the resulting discomfort and lower back pain to the user.

Although the existing portable seats mitigate the problems associated with lumbar and/or butt support, such seats lack versatility for storing items such as but not limited to baby products, cosmetics and the like. Thus, to accommodate these items, the user may be required to carry bags, pouches, containers and the like which is laborious and undesirable. This situation is particularly disadvantageous, for users such as parents or caretakers traveling with an infant or a toddler, as they are required to carry multiple products to take care of the child outside the home.

In view of the above, there is a need of a convertible seat which can overcome one or more limitations stated above.

SUMMARY

Various embodiments of the present disclosure provide a convertible seat for achieving a seat mode and a baby care mode (e.g., a diaper changing station mode).

The present disclosure provides a convertible seat. The convertible seat includes a seat member and a backrest member pivotally mounted to the seat member. The backrest member is configured to at least assume a folded position, a first unfolded position and a second unfolded position. The first unfolded position is a seat mode and the second unfolded position is a diaper changing station mode. The backrest member in the seat mode is inclined relative to the seat member to enable an adult accompanying an infant to sit and the backrest member in the diaper changing station mode is aligned with a longitudinal plane of the seat member to enable an infant to rest for replacement of a diaper. The convertible seat further includes a plurality of storage compartments configured on at least one of the seat member and the backrest member for storing baby products and domestic items. A compartment of the plurality of compartments is configured with a sterile surface. The compartment, when laid-out on the seat member and the backrest member in the diaper changing station mode, allows the infant to rest on the sterile surface for replacement of the diaper.

In an embodiment, the present disclosure also provides the convertible seat. The convertible seat includes the seat member and the backrest member pivotally mounted to the seat member. The backrest member is configured to at least assume the folded position, the first unfolded position and the second unfolded position. The first unfolded position is the seat mode and the second unfolded position is the diaper changing station mode. The backrest member in the seat mode is inclined relative to the seat member to enable an adult accompanying an infant to sit and the backrest member in the diaper changing station mode is aligned with a longitudinal plane of the seat member to enable an infant to rest for replacement of a diaper. The convertible seat further includes a plurality of storage compartments configured on at least one of the seat member and the backrest member for storing baby products and domestic items. A compartment, of the plurality of compartments is configured with a sterile surface. The compartment, when laid-out on the seat member and the backrest member in the diaper changing station mode, allows the infant to rest on the sterile surface for replacement of the diaper. The convertible seat further includes a changing pad configured on an interior surface of at least one of the seat member and the backrest member. The changing pad is configured to assume a collapsed position and a deployed position. The changing pad assumes the deployed position from the collapsed position when the backrest member is in the diaper changing station mode for providing a surface for the infant to rest during replacement of the diaper, wherein the surface may be a sterile surface.

In another embodiment, the present disclosure also provides the convertible seat. The convertible seat includes the seat member and the backrest member pivotally mounted to the seat member. The backrest member is configured to at least assume the folded position, the first unfolded position and the second unfolded position. The first unfolded position is the seat mode and the second unfolded position is the diaper changing station mode. The backrest member in the seat mode is inclined relative to the seat member to enable an adult accompanying an infant to sit and the backrest member in the diaper changing station mode is aligned with a longitudinal plane of the seat member to enable an infant to rest for replacement of a diaper. The convertible seat further includes a plurality of storage compartments configured on at least one of the seat member and the backrest member for storing baby products and domestic items. A compartment of the plurality of compartments is configured with a sterile surface. The compartment, when laid-out on the seat member and the backrest member in the diaper changing station mode, allows the infant to rest on the sterile surface for replacement of the diaper. A changing pad is configured on an interior surface of at least one of the seat member and the backrest member. The changing pad is configured to assume a collapsed position and a deployed position. The changing pad assumes the deployed position from the collapsed position when the backrest member is in the diaper changing station mode for providing a sterile surface for the infant to rest during replacement of the diaper. Further, a compartment of the plurality of compartments is made of fabric material and configured to extend from the backrest member and positioned adjacent to one or more strap members, wherein the compartment is configured with an opening for holding a bottle.

BRIEF DESCRIPTION OF THE FIGURES

For a more complete understanding of example embodiments of the present technology, reference is now made to the following descriptions taken in connection with the accompanying drawings in which.

Figure 1:
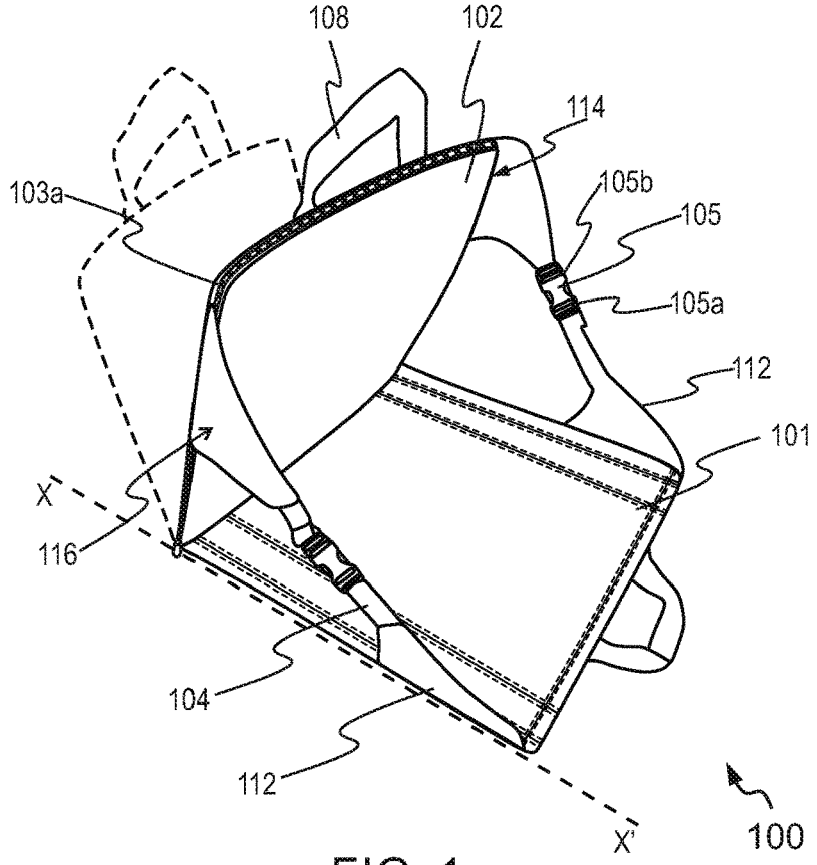
FIG. 1 illustrates a schematic representation of a convertible seat, in accordance with at least some exemplary embodiments of the present disclosure.

The drawings referred to in this description are not to be understood as being drawn to scale except if specifically noted, and such drawings are only exemplary in nature. Further, the drawings provided herein are merely for the purposes of understanding of the present invention, and should not be construed as a limitation by one skilled in the art.

DETAILED DESCRIPTION

While the invention is susceptible to various modifications and alternative forms, specific embodiments thereof have been shown with the help of examples in the drawings and are described in detail below. It should be understood, however that it is not intended to limit the invention to the particular forms disclosed, but on the contrary, the invention is intended to cover all modifications, equivalents, and alternative fallings within the spirit and the scope of the invention.

In the following description, for purposes of explanation, numerous specific details are set forth in order to provide a thorough understanding of the present disclosure. It will be apparent, however, to one skilled in the art that the present disclosure can be practiced without these specific details.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification is not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

Moreover, although the following description contains many specifics for the purposes of illustration, anyone skilled in the art will appreciate that many variations and/or alterations to said details are within the scope of the present disclosure. Similarly, although many of the features of the present disclosure are described in terms of each other, or in conjunction with each other, one skilled in the art will appreciate that many of these features can be provided independently of other features. Accordingly, this description of the present disclosure is set forth without any loss of generality to, and without imposing limitations upon, the present disclosure.

It must be noted that the terms, 'foldable' and 'portable' have been used interchangeably throughout the description and are used to explain a floor seat that is foldable as well as portable.

Further, the term "user" throughout the description, unless the context suggests otherwise, refers to a caretaker or a guardian of an infant or a toddler.

Overview

Embodiments of the present disclosure provide a convertible seat, defined by a seat member and a backrest member, with the backrest member pivotally mounted at an aft end of the seat member. The convertible seat is adapted to assume a seat mode and a diaper changing station mode as per the usage. In the seat mode, the backrest member may be vertical or inclined at an angle with respect to the seat member, to enable a person such as an adult accompanying an infant/toddler to sit on the convertible seat, while providing lumbar support to the person. In the diaper changing station mode, the backrest member may be aligned along the same plane as the seat member, to enable an infant or a toddler to lie down on the convertible seat. In the diaper changing station mode, the infant may lie down on the convertible seat, so that a user (such as a caretaker/guardian) can replace a diaper of the infant with the infant experiencing minimal discomfort and exposure to dirt or unsanitary surfaces. Further, the convertible seat is also defined with a plurality of storage compartments for storing items including but not limited to baby supplies, domestic supplies or any other items as per the user's requirement. The storage compartments store the required items therein, so that the user can access and use the items as per necessity and requirement. In an embodiment, inner surface of one storage compartment may be configured with a sterile surface. When the storage compartment is opened and laid out in the seat mode, it opens such that substantially half of the storage compartment is attached with the backrest member and another half rests on the seat member or vice versa. Thereafter, the infant can be placed over the sterile surface of laid out storage compartment as described herein later in this description.

Additionally or alternatively, the convertible seat includes a changing pad mounted on at least one of the seat member and the backrest member. The changing pad may be configured to assume a collapsed position and a deployed position. The changing pad can be in the collapsed position during the folded position of the backrest member or when the convertible seat is in the seat mode. Further, the changing pad can be put in the deployed position by the person accompanying the infant, when the backrest member is in the diaper changing station mode. As such, the changing pad is configured to provide a surface for the infant or the toddler, wherein the surface may be a sterile surface.

Various exemplary embodiments of the convertible seat with multiple functionalities, such as but not limited to the diaper changing station are herein explained with reference to FIG. 1 to FIGS. 11A-11B.

Figure 2:
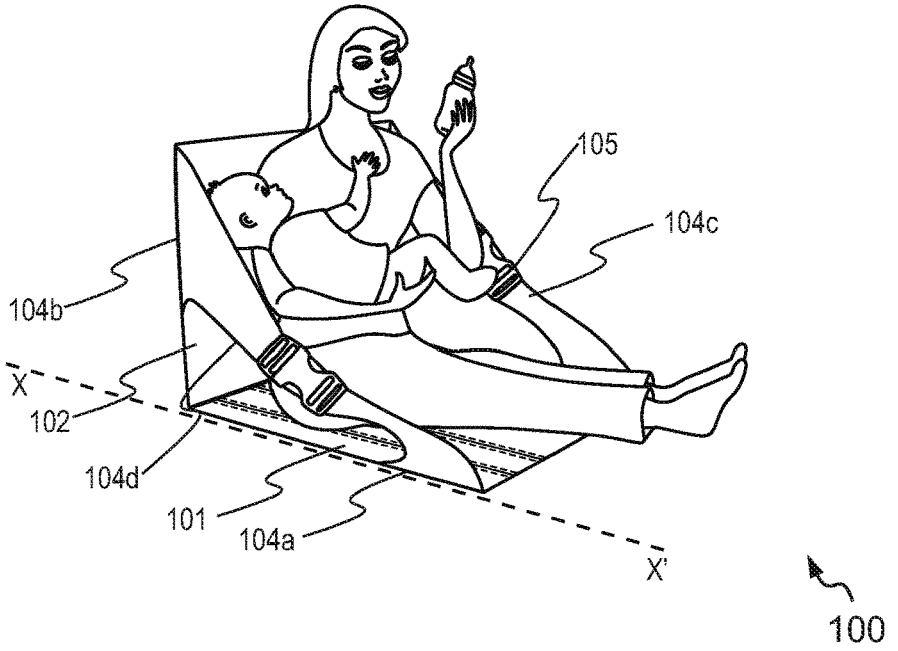
FIG. 2 illustrates a schematic representation of a person resting on the convertible seat in a seat mode, in accordance with an exemplary embodiment of the present disclosure.
Figure 7A:
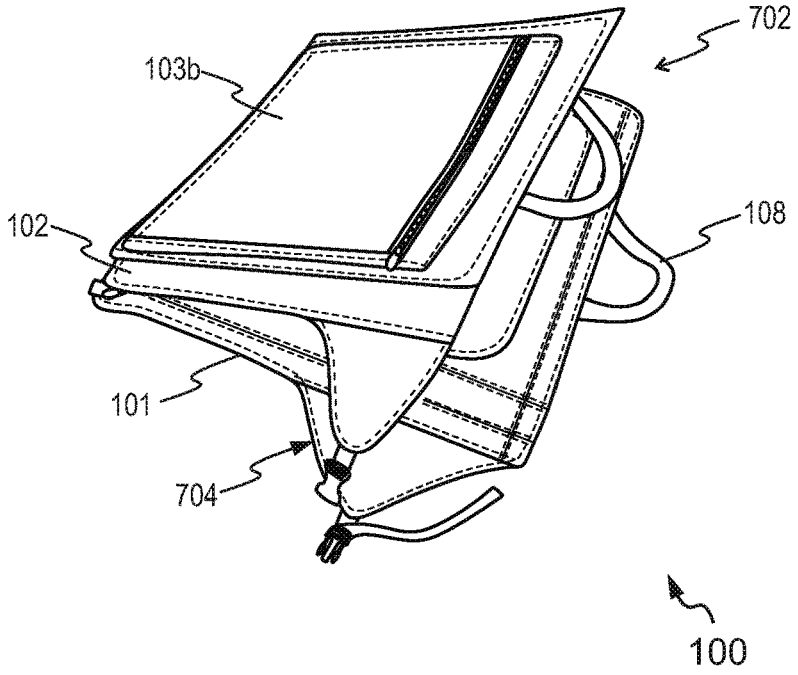
FIGS. 7A, 7B and 7C illustrate stage-wise articulation of the convertible seat to a folded condition, in accordance with exemplary embodiments of the present disclosure.

FIG. 1 illustrates a schematic representation of a convertible seat 100, in accordance with an exemplary embodiment of the present disclosure. The convertible seat 100 is configured with a seat member 101 and a backrest member 102, such that the backrest member 102 is pivotally mounted at an aft end of the seat member 101. The pivotal connection between the seat member 101 and the backrest member 102 ensures that the user may articulate the convertible seat 100 or the backrest member 102 to a folded position 702 (for e.g. as shown in FIG. 7A), a first unfolded position and a second unfolded position. As such, the backrest member 102 may assume the folded position 702, the first unfolded position and the second unfolded position. In one configuration, the first unfolded position may be a seat mode 114, while the second unfolded position may be a diaper changing station mode 404 (e.g., as shown in FIGS. 4B or 9A-9C) as per requirement. In the seat mode 114, the person such as an adult can be seated on the convertible seat 100 with suitable lumbar support from the backrest member 102 (e.g. as shown in FIG. 2). In the diaper changing station mode 404, the user may place the infant on the convertible seat 100, so that the user may tend to the infant. In another configuration, the backrest member 102 may be configured to assume the folded position 702 and a plurality of unfolded positions. The plurality of unfolded positions may include the first unfolded position (see, 114) and the second unfolded position (see, 404), or any other intermediate position as per design feasibility and requirement.

Figure 3:
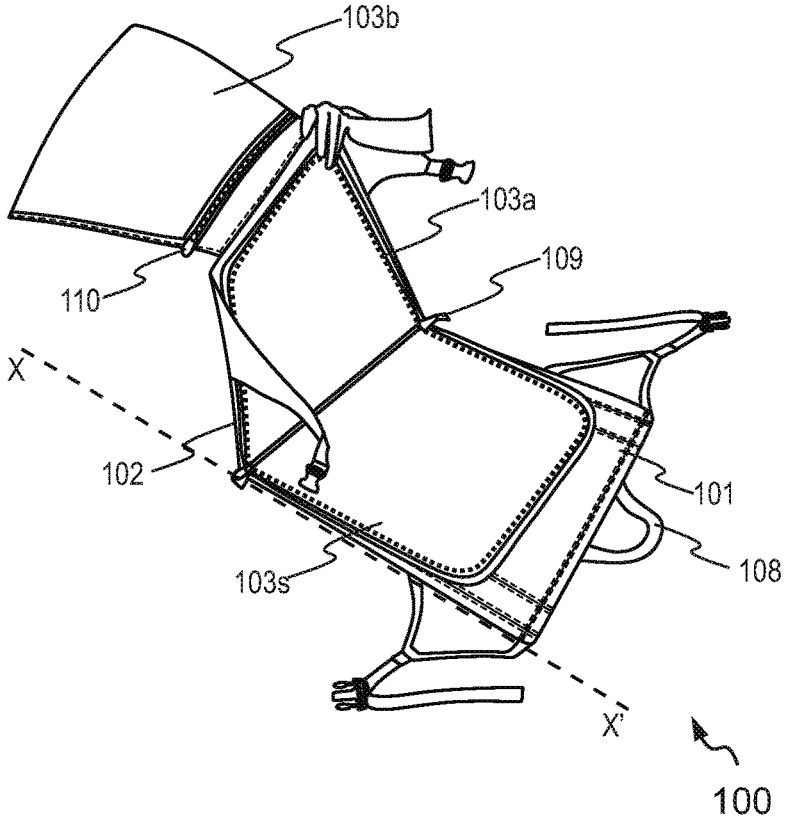
FIG. 3 illustrates a schematic representation of storage compartments configured on a backrest member of the convertible seat of FIG. 1, in accordance with an exemplary embodiment of the present disclosure.

Referring to FIG. 3, the convertible seat 100 also includes a plurality of storage compartments 103*a* and 103*b*, defined on at least one of the seat member 101 and the backrest member 102. The storage compartments 103*a* and 103*b* are adapted to receive and store items such as but not limited to a diaper 106, a diaper changing mat (not shown), baby products and domestic items, as per user's requirement. The storage compartments 103*a* and 103*b* may be strategically located inside or outside of at least one of the seat member 101 and the backrest member 102, so that the convertible seat 100 may store a maximum number of items as per user's requirement, while also maintaining its portability. In one configuration, the storage compartments 103*a* and 103*b* are illustrated for exemplary purposes. As such, the present disclosure is not intended to limit the number and configuration of the compartments to storage compartments 103*a* and 103*b*. In an embodiment, the storage compartments 103*a* and 103*b* may be fastened to at least one of the seat member 101 and the backrest member 102 as per feasibility and requirement. In another embodiment, the storage compartments 103*a* and 103*b* may be integrally formed within the convertible seat 100 in the form of pockets or containers. The storage compartment 103*a* may be defined with a securing means 109 for securing the contents therein. Further, the storage compartment 103*b* may be defined with an attaching means 110 for securing the contents therein. Additionally or alternatively, the storage compartments 103*a* and 103*b* may be made of materials, which do not degrade the shelf-life of the items stored within. Additionally or alternatively, the storage compartments 103*a* and 103*b* may also be made of materials such as but not limited to water-proof materials, to prevent water from seeping into the storage compartments 103*a* and 103*b*.

Figure 4A:
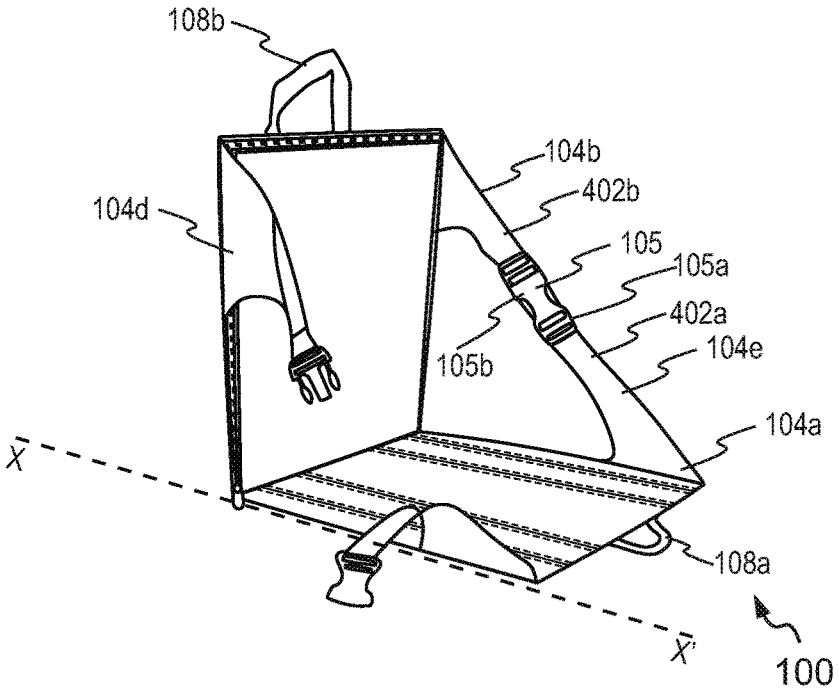
FIGS. 4A to 4D illustrate a step wise articulation of the convertible seat from the seat mode to a diaper changing station mode, in accordance with an exemplary embodiment of the present disclosure.
Figure 4B:
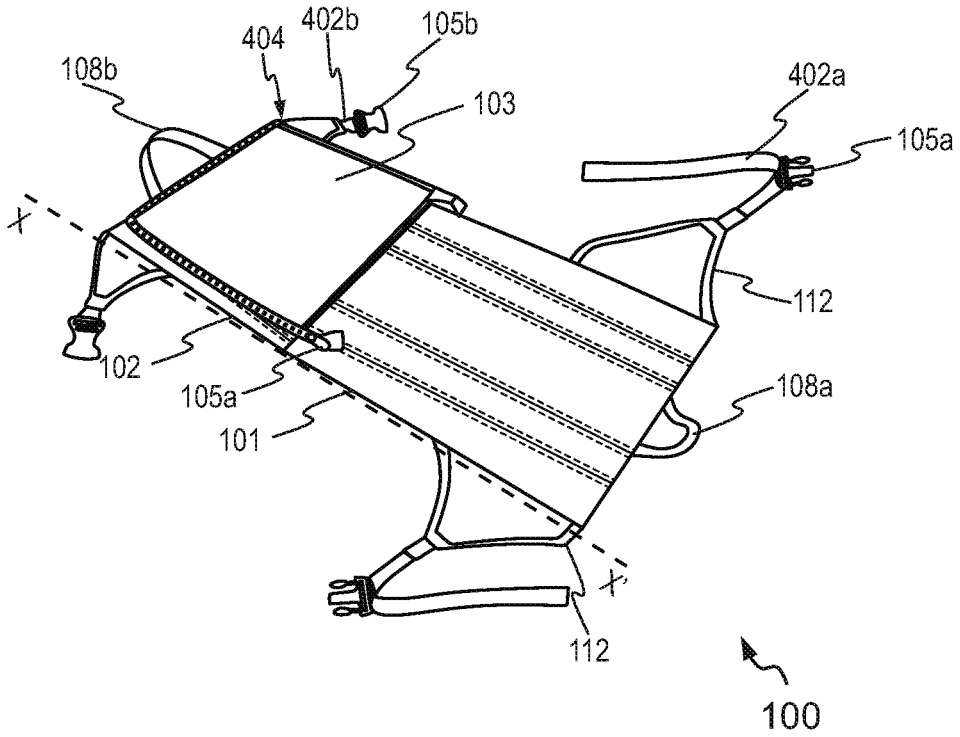
Figure 4C:
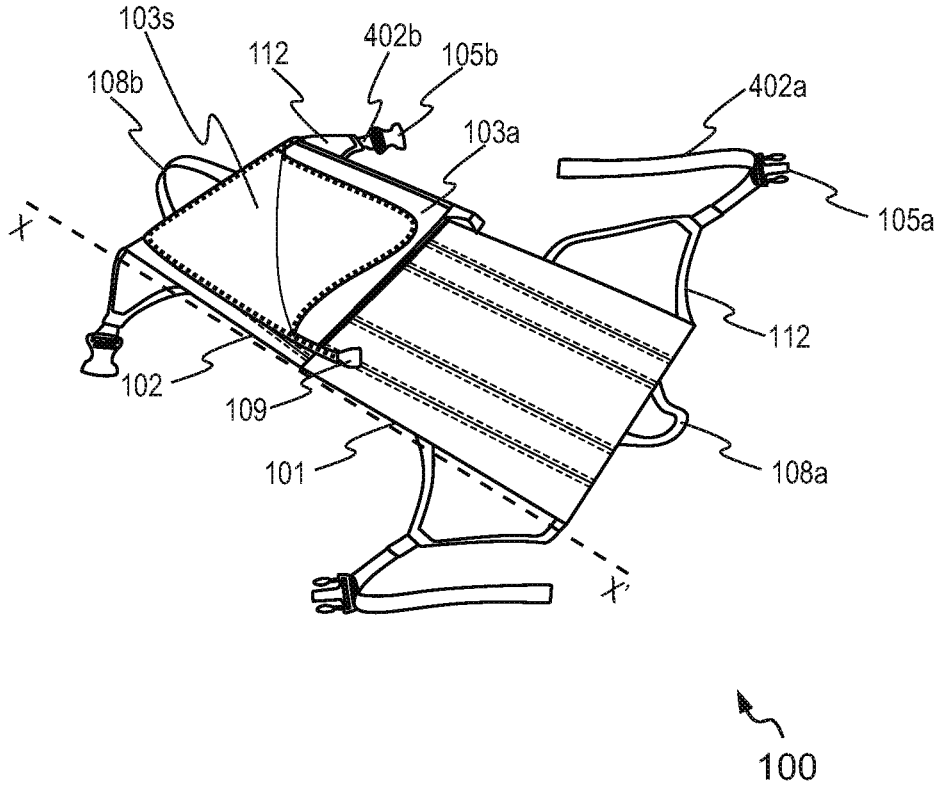
Figure 4D:
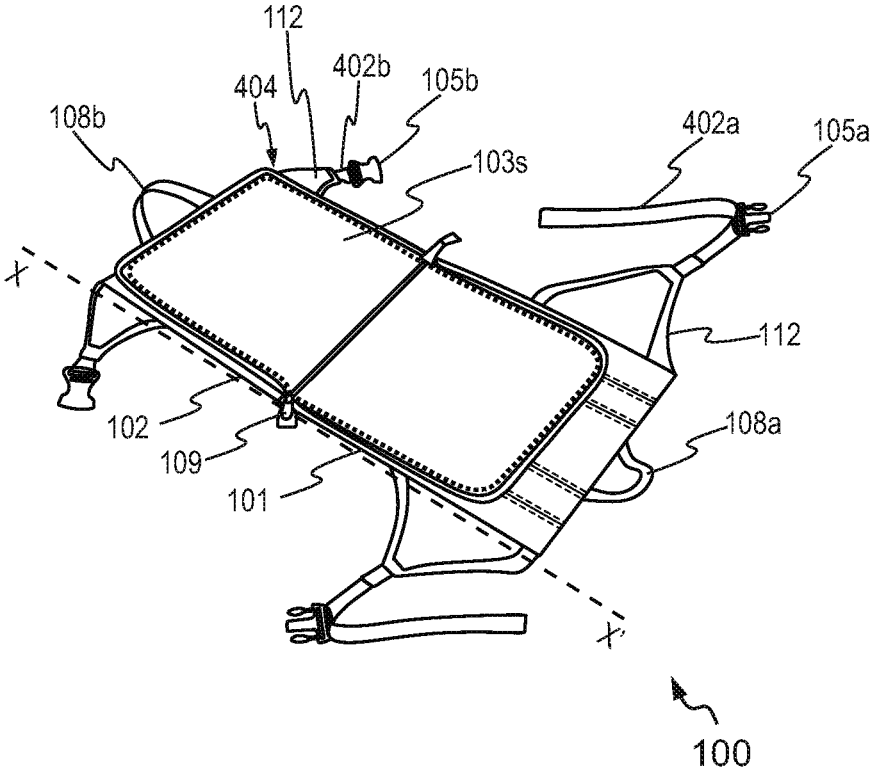
Figure 5:
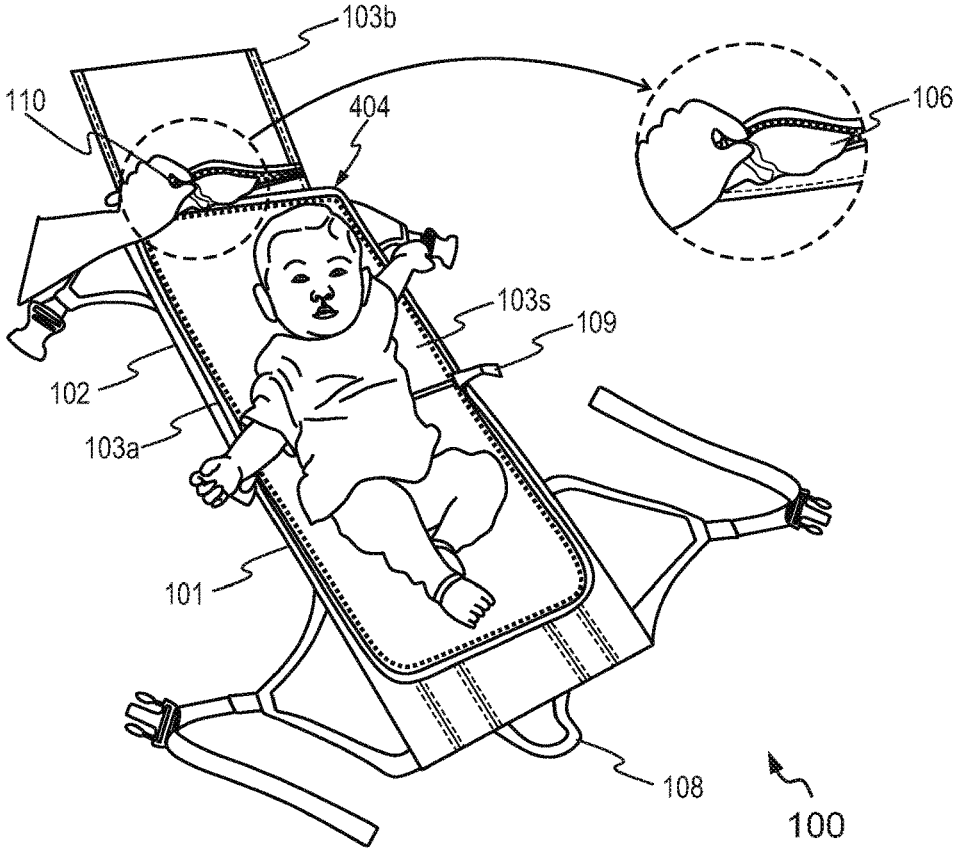
FIG. 5 illustrates a schematic representation of a user accessing a diaper or wipes stored within the storage compartments for changing a diaper of an infant, in accordance with an example embodiment of the present disclosure.
Figure 6:
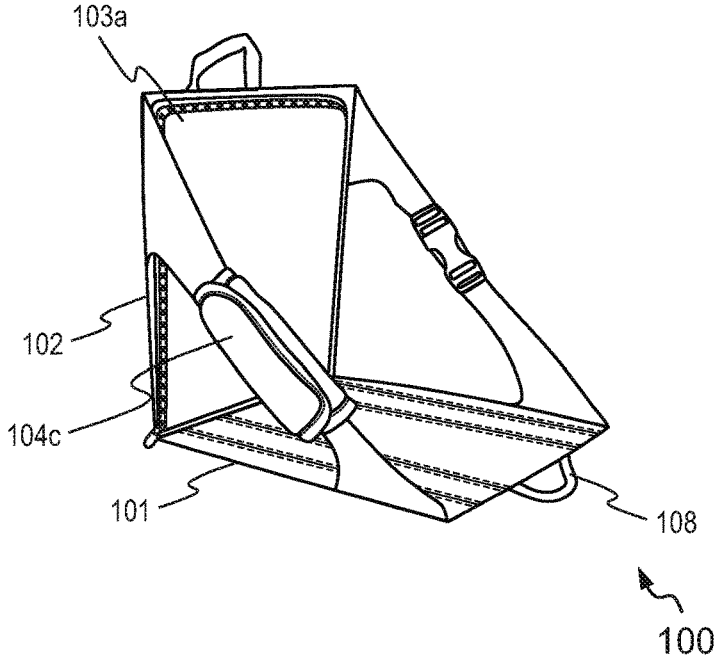
FIG. 6 illustrates a perspective view of the convertible seat with a padded sleeve wrapped on fastening means of straps, in accordance with an exemplary embodiment of the present disclosure.

In an embodiment, the storage compartment 103*a* may include the sterile surface 103*s* (e.g. as shown in FIGS. 4C and 4D), on its inner surface, so that infant or toddler may be laid over the sterile surface 103*s*. In an embodiment, the sterile surface 103*s* may be made of materials such as but not limited to sterile cotton, rubber, polyvinyl chloride (PVC), polyurethane (PU), silicone elastomer, fluoropolymers, or wax or any other material which serves the purpose. In another embodiment, the diaper changing mat (not shown) stored in the storage compartment 103*a* or 103*b*, may be laid-out on the convertible seat 100 in the diaper changing station mode 404, so that the diaper changing mat may act as a sterile surface 103*s* for the infant or toddler (e.g. as shown in FIG. 5).

Referring back to FIG. 2, the convertible seat 100 further includes one or more strap members 104 (hereinafter referred to as 'strap members 104'), with a first end 104*a* secured to the seat member 101 and a second end 104*b* secured to the backrest member 102. The strap members 104 are adapted to maintain a position of the seat member 101 and the backrest member 102, thereby preventing a collapse of either of the seat member 101 and the backrest member 102 during use in the seat mode 114. Additionally, the strap members 104 are adapted to be scalable in dimension so that the inclination between the seat member 101 and the backrest member 102 is adjustable as per user's requirement. This configuration of adjustment of the inclination of the backrest member 102, promotes better lumbar support to the person such as an adult as per requirement. In an embodiment, the strap members 104 may be scalable in a length dimension, for adjusting the inclination between the seat member 101 and the backrest member 102. Also, the strap members 104 are scalable in dimension, so that sufficient rigidity and reinforcement is imparted to the seat member 101 and the backrest member 102 during use. In other words, the strap members 104 provide sufficient reinforcement and rigidity, to the seat member 101 and the backrest member 102, thereby preventing a collapse of the convertible seat 100 during use. In an embodiment, the strap members 104 may be scalable in a width dimension and a thickness dimension, for providing sufficient reinforcement and rigidity to the seat member 101 and the backrest member 102. The strap members 104 may also be configured with tapering dimensions to compensate the length and rigidity requirements. In other words, the width dimension of the strap members 104 may be maximum at the ends connected to the seat member 101 and the backrest member 102, while maintaining minimal width dimension between the ends. In one configuration, the strap members 104 are configured to be folded and bonded together via conventional bonding means, to ensure rigidity during use. As such, the strap members 104 provide sufficient support to the configuration of the convertible seat 100 during use.

Referring to FIG. 4A, the strap members 104 may be configured with at least one fastening means 105 (hereinafter referred to as 'fastening means 105') along its length. The fastening means 105 may enable the user to alter the length dimension of the strap members 104, thereby adjusting inclination between the seat member 101 and the backrest member 102 in the seat mode 114. The fastening means 105 may also enable the user to detach connection between the seat member 101 and the backrest member 102, so that the backrest member 102 may be configured in the diaper changing station mode 404. In one configuration, the fastening means 105 includes a male engagement member 105*a* and a female engagement member 105*b* (for e.g. as shown in FIG. 1). The male engagement member 105*a* may be coupled to a first segment 402*a* (for e.g. as shown in FIG. 4A) of the strap member 104, via conventional coupling means. The female engagement member 105*b* may be coupled to a second segment 402*b* (for e.g. as shown in FIG. 4A) of the strap member 104, via conventional coupling means. The male engagement member 105*a* is configured to be coupled with the female engagement member 105*b* for enabling the backrest member 102 to assume the seat mode 114. Also, the male engagement member 105*a* is configured to be disconnected with the female engagement member 105*b* for enabling the backrest member 102 to assume the diaper changing station mode 404. In one configuration, the fastening member is a buckle strap member. As such, the male engagement member 105*a* is a buckle pin, while a buckle slot acts as a female engagement member 105*b*. The fastening member is selected based on the size and configuration of the strap members 104. In yet another configuration, the strap members 104 may be connected to the seat member 101 and the backrest member 102 via a wing member 112. The wing member 112 is configured to reinforce the connection with the seat member 101 and the backrest member 102. The strap members 104 may be oriented suitably, based on the configuration of the wing member 112, for coupling therebetween. In one implementation, the wing member 112 may be triangular in configuration. In this configuration, the strap members 104 may be coupled to one of the vertices of the wing member 112 via conventional coupling means. In another implementation, the shape of the wing member 112 may be a square shape, a rectangular shape or any other shape as per design feasibility and requirement.

Upon detachment of the strap members 104, the seat member 101 and the backrest member 102 can be operated by the user, so that the convertible seat 100 may be configured from the seat mode 114 to the diaper changing station mode 404 (e.g., as shown in FIG. 4B). In the diaper changing station mode 404, the convertible seat 100 may act as a mattress to facilitate the infant/toddler to rest or sleep. Also, in this mode, the user may make the infant lie down on the convertible seat 100, so that the user may tend to the infant, such as but not limited to changing a diaper 106 of the infant (e.g., as shown in FIG. 5) or changing clothes of the infant. In an embodiment, the user may operate the backrest member 102, by inclining the backrest member 102 by an angle ranging from 90 degrees to about 180 degrees with respect to the seat member 101.

Referring to FIG. 4C, the user, prior to placing the infant on the convertible seat 100, may unfasten one of the storage compartment 103*a* and spread over the backrest member 102 and the seat member 101 (e.g. as shown in FIG. 4D). In this condition, the inner layer of the storage compartment 103*a* may act as the sterile surface 103*s* for the infant to lie down.

Referring to FIG. 5, once the sterile surface 103*s* is spread out on the convertible seat 100, the infant is placed over the sterile surface 103*s*. Subsequently, the user may access the diaper 106 stored in the storage compartment 103*b*, for changing the infant's diaper 106 with ease. In an embodiment, the user may also access baby products or domestic items from the storage compartment 103*b* for treating the infant.

Figure 8:
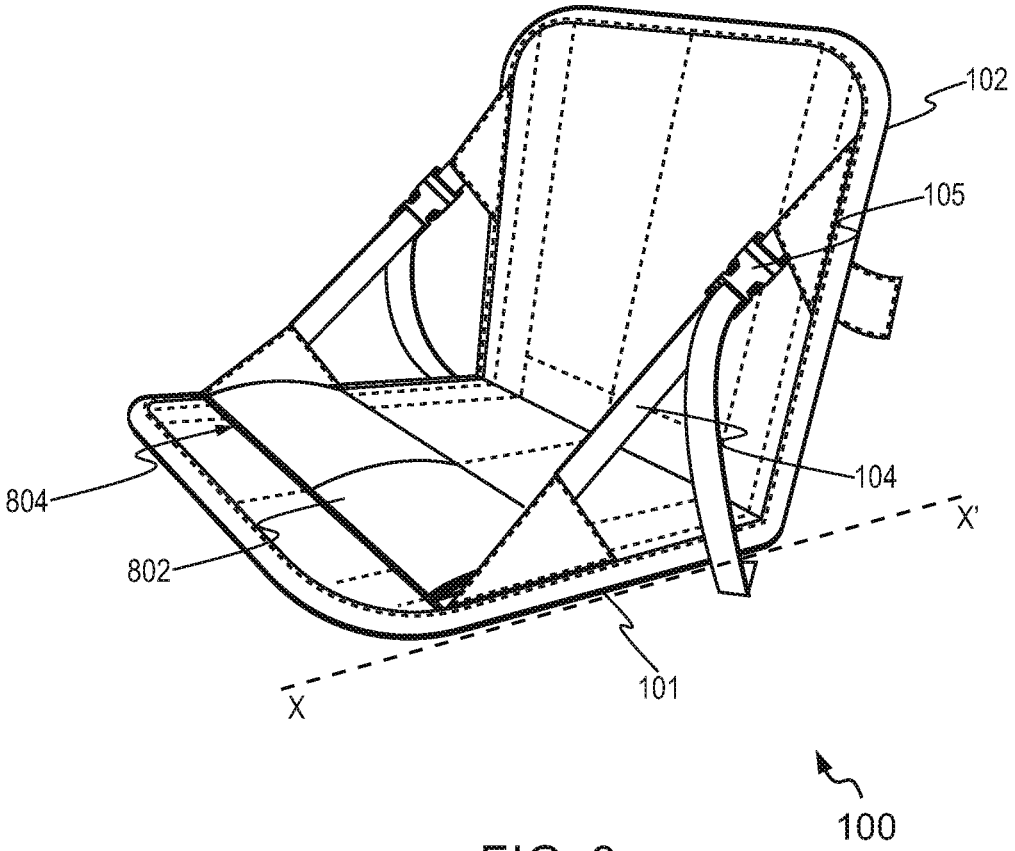
FIG. 8 illustrates a perspective view of the convertible seat with a changing pad, in accordance with an exemplary embodiment of the present disclosure.

Referring to FIG. 8 in conjunction with FIG. 1, a changing pad 802 is mounted on the seat member 101. The changing pad 802 is configured to assume a collapsed position 804 and a deployed position 902 (for e.g. as shown in FIG. 9C). The changing pad 802, in the deployed position 902, is configured to provide a sterile resting surface to the infant and/or the adult for resting on the seat 100 or to enable an adult to replace the diaper 106 of the infant. The changing pad 802 may be a sheet like structure made of sterile material and is dimensioned corresponding to the dimensions of the seat 100. The changing pad 802 has one end coupled to either of the seat member 101 or the backrest member 102, while the other end is unrestrained or free. This configuration enables the user such as the adult, to deploy the changing pad 802 suitably on the seat 100 during requirement. In one embodiment, either of the changing pad 802 or the storage compartment 103*b* providing a sterile surface 103*s* may be detachable from the seat 100. This configuration provides the user for cleaning the sterile surface 103*s* of either the changing pad 802 or the storage compartment 103*b*.

Further, the changing pad 802 conforms to the dimensions of the seat 100, during the collapsed position 804 and the deployed position 902. As an example, the changing pad 802 is mounted to the seat member 101 and is dimensioned to conform to the width of the seat member 101. The changing pad 802 is folded suitably to the collapsed position 804 for ease of folding of the seat 100. The folding may be a three-fold structure, foldable along the longitudinal plane of the seat 100 which is selected based on the configuration of the seat 100. Further, the changing pad 802 may also include multiple layers, which may include a foam layer which acts as a cushion to the user during use (not shown in Figures). Additionally, the free end of the changing pad 802 may be configured with a securing means (not shown in Figures) to ensure that the free end is fixed on the seat member 101 in the deployed position 902. This configuration ensures that the changing pad 802 is secured suitably on the seat 100 in the deployed position 902. In one configuration, the shape of the changing pad 802 may be rectangular.

Figure 9A:
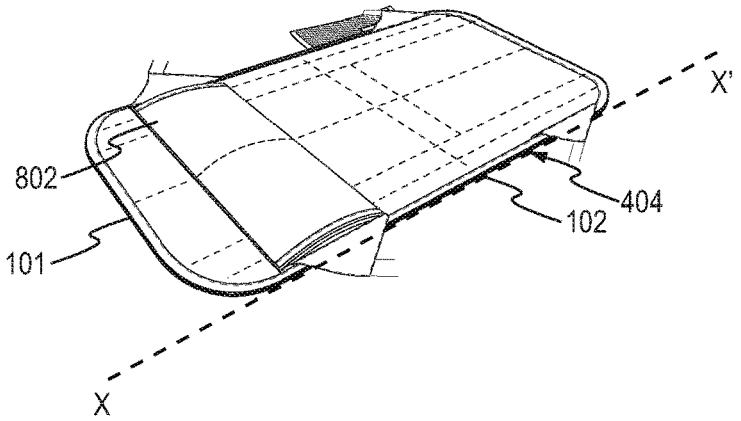
FIGS. 9A, 9B and 9C illustrate stage-wise articulation of the changing pad on the convertible seat in the diaper changing station mode, in accordance with exemplary embodiments of the present disclosure.
Figure 9B:
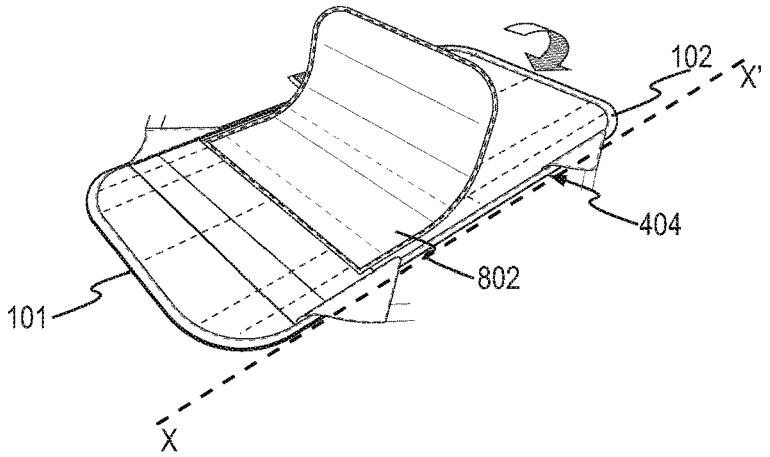
Figure 9C:
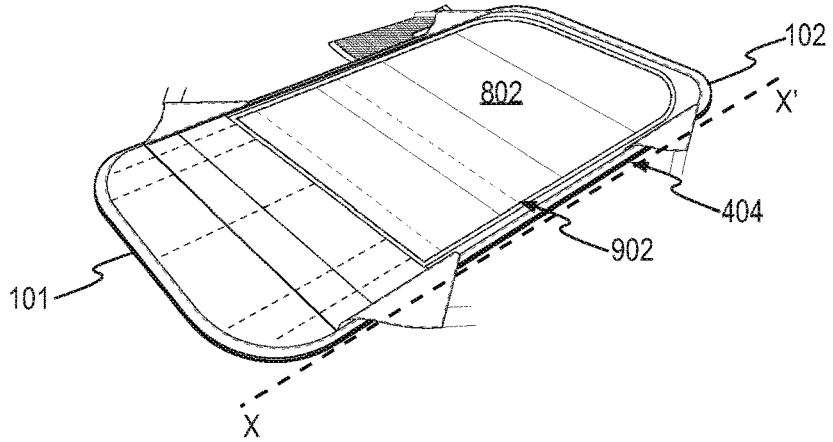

Referring to FIGS. 9A-9C, deployment of the changing pad 802 from the collapsed position 804 to the deployed position 902 is illustrated. The changing pad 802 is in the collapsed position 804 initially, when the seat 100 is in either the seat mode 114 or the diaper changing station mode 404. When the user (i.e. person accompanying the infant) needs to replace the diaper 106 of the infant, the seat 100 is deployed to the diaper changing station mode 404 from the seat mode 114 or the folded position 702. As an example, the position of the changing pad 802 when the seat is in the diaper changing station mode 404 is illustrated in FIG. 9A. In this scenario, the user now initiates the deployment of the changing pad 802 (for e.g. as shown in FIG. 9B), by unfolding the changing pad 802. Subsequently, the changing pad 802 is deployed completely, to the deployed position 902 as shown in FIG. 9C. In this position, the free end of the changing pad 802 meets the backrest member 102, so as to conform to the longitudinal axis or plane X-X' of the seat member 101. Thus, the changing pad 802 conforms to the same level as that of the seat member 101, thereby ensuring a smooth surface for the user to rest on the seat 100.

In one configuration, the changing pad 802 is mounted proximal to the wing member 112 of the seat 100. In one implementation, the changing pad 802 may be used when the backrest member 102 is in the diaper changing station mode 404. In another implementation, the changing pad 802 may also be used, when the backrest member 102 is in the seat mode 114, as per the requirement.

Figure 10:
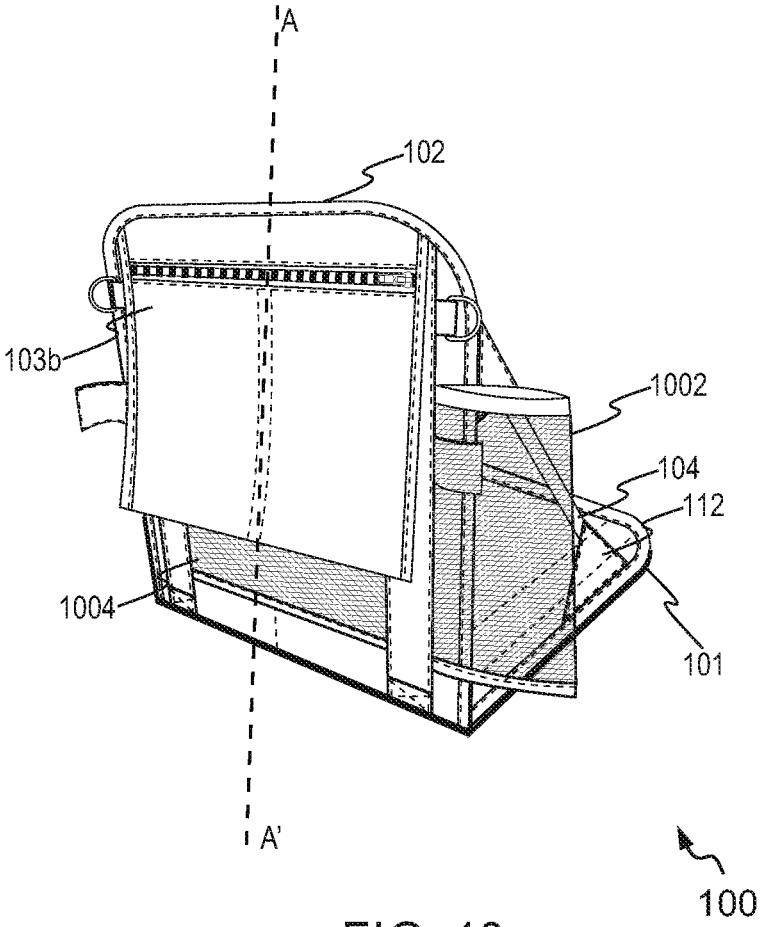
FIG. 10 illustrates a perspective view of the convertible seat with a compartment of the plurality of compartments made of fabric material, in accordance with an exemplary embodiment of the present disclosure.

In an embodiment, the seat 100 further includes compartments, for e.g. 1002 and 1004 made of fabric material (for e.g. as shown in FIG. 10). Without limiting to the scope of present disclosure, in an embodiment, the fabric material may be in form of meshed fabric. Some examples of the fabric material of the compartments 1002 and 1004 may be polyester, nylon, acrylic or similar synthetic fabric. The fabric material may be configured to be of a pouch configuration, with an opening (not shown in Figures) provided for receiving the contents to be stored. The opening may be provided with suitably securing means (such as securing means 109) to ensure that the contents are secured within the compartment 1004.

Further, the compartment 1002, also made of fabric material, may extend away from the seat member 101 or the backrest member 102 towards one of the one of more strap members 104. The compartment 1002 is configured to be a pocket, which is adapted to function as a bottle holder, for enabling the user to store a bottle (not shown in Figures). As such, the compartment 1002 may be configured so as to enable bottle of varying sizes to be accommodated as per design feasibility and requirement. In one implementation, the fabric material of the compartment 1002 may be elastic fibers or similar material to ensure that the contents are securely held within the compartment 1002.

Figure 11A:
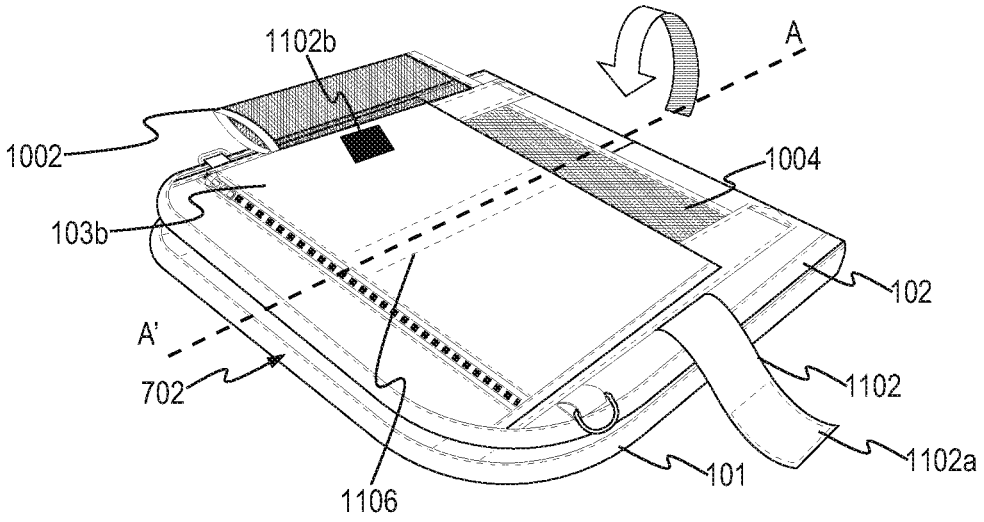
FIGS. 11A and 11B illustrate perspective views of the convertible seat with the compartment made of fabric material in folded position, in accordance with an exemplary embodiment of the present disclosure.
Figure 11B:
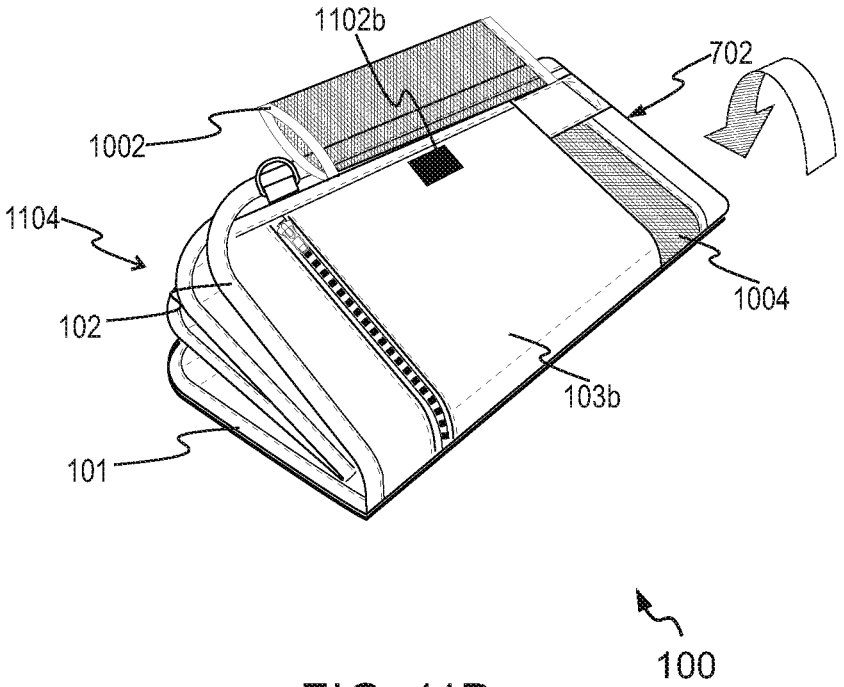

Referring to FIGS. 11A and 11B, the perspective views of the seat 100 with the fabric material compartments 1002 and 1004, in the folded position 702, are shown. As illustrated, the compartment 1004 may either be positioned on outer surface of either of the seat member 101 or the backrest member 102. In another configuration, the compartment 1004 may be provided below the compartment 103*b*, so that the compartment 103*b* may at least partly conceal the compartment 1004 and contents stored therein (for e.g. as shown in FIG. 11A). This configuration ensures that the contents within the compartment 1004 are further protected. The compartment 1002 remains outside the seat 100 to ensure that the bottle stored therein is accessible to the user, even when the seat 100 is in the folded position 702. Moreover, the concealment of the compartment 1004, provides a clean and refreshed exterior look and feel of the seat 100, thereby enhancing the aesthetic appeal. Upon concealing the compartment 1004, the seat 100 is completely folded, to the folded position 702. In one configuration, the changing pad 802 can be operated to the collapsed position 804, prior to the folding of the seat 100.

Figure 7B:
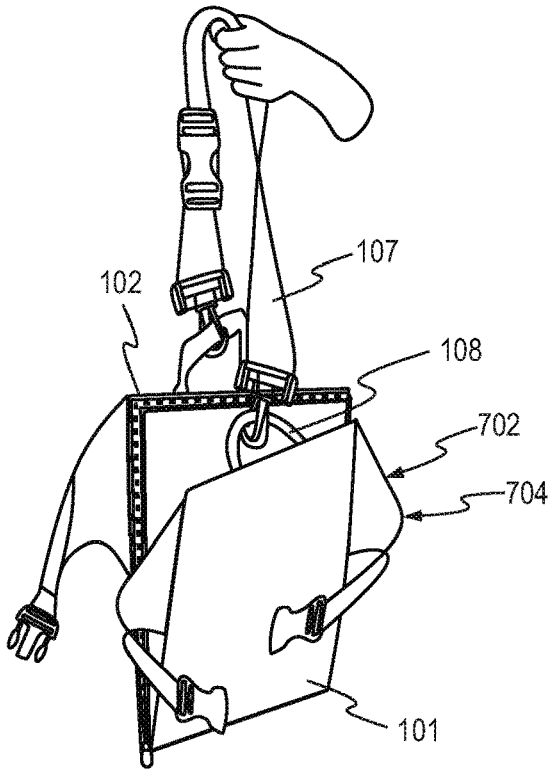
Figure 7C:
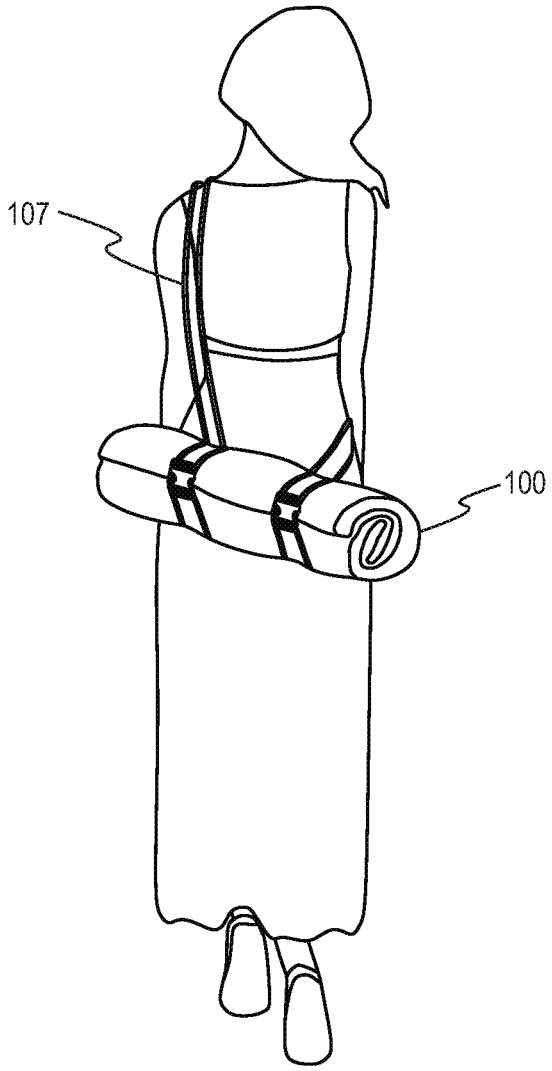

Referring now to FIGS. 7A to 7C, stepwise articulation of the convertible seat 100 from the diaper changing station mode 404 to the folded position 702 is shown, in accordance with an embodiment of present disclosure. After use of the convertible seat 100, the user folds each of the storage compartments 103*a* and 103*b*, the backrest member 102 and the seat member 101 back in place (e.g. as shown in FIG. 7A), to facilitate transport. It is noted that the compartment 103*b* when laid out in the diaper changing station mode 404, is closed (e.g., using securing means 109) prior to folding of the seat 100. Further, in the embodiment that includes the changing pad 802, the changing pad 802 is reverted to the collapsed position 804 from the deployed position 902 prior to folding of the seat 100. In the folded position 702, size of the convertible seat 100 is compacted, thereby facilitating ease of transport. In an embodiment, a shoulder strap 107 (e.g. as shown in FIG. 7B) may be attached to the convertible seat 100 for ease of handling.

In an embodiment, the storage compartment 103*b* may be defined on the backrest member 102 of the convertible seat 100. The storage compartment 103*b* may be required to be flipped out (e.g. as shown in FIG. 3) for accessing its contents.

In an exemplary embodiment, the strap members 104 may include a first strap member 104*d* and a second strap member 104*e* (e.g. as shown in FIGS. 2 and 4A). The first strap member 104*d* may be secured to a left-side portion of the seat member 101 and the backrest member 102, while the second strap member 104*e* may be secured to the right-side portion of the seat member 101 and the backrest member 102. Further, the first strap member 104*d* and the second strap member 104*e* may be split into multiple segments, with each segment connected to each other by the fastening means 105. In an embodiment, the first strap member 104*d* and the second strap member 104*e* may be split into two segments. In an exemplary embodiment, the segments of the first strap member 104*d* and the second strap member 104*e* may be connected by a buckle.

In an embodiment, the strap members 104 are operable between an extended position 116 (for e.g. as shown in FIG. 1) and a retracted position 704 (for e.g. as shown in FIG. 7A). In the retracted position 704, the strap members 104 may be folded, thereby allowing the convertible seat 100 to be in either of the folded position 702 or the diaper changing station mode 404. In the extended position 116, the strap members 104 may be adapted to maintain the position of the backrest member 102 with respect to the seat member 101.

In an embodiment, the strap members 104 may be connected at free ends of the seat member 101 and the backrest member 102, to form a diagonal connection. In an embodiment, the location of connection of the strap members 104 with the seat member 101 and the backrest member 102 is selected to provide optimum rigidity to the convertible seat 100 during use. The location of the strap members 104 may also be selected such that the straps do not hinder comfort of the user during use.

In an embodiment, the strap members 104 may be flexible members, which can elongate corresponding to the person's load, thereby adjusting a position of the seat member 101 and the backrest member 102.

In an embodiment, the strap members 104 may include a padded sleeve 104*c* (shown in FIG. 6) provided over the fastening means 105, to prevent discomfort to the person, in the event the person contacts the fastening means 105 during use.

In an embodiment, the fastening means 105 is selected from a group including but not limited to a buckle, a Velcro™, a clip, a loop, a tie, a snap or any other means which serves the design feasibility and requirement. In an embodiment, the seat member 101 and the backrest member 102 may be defined with at least one cushion member (not shown), for infant's comfort during use of the convertible seat 100 in the diaper changing station mode 404. In an exemplary embodiment, the fabric of the cushion member may be selected from materials such as foam, cotton canvas, textile fabric, vinyl, synthetic fiber or any other material which provides the necessary cushion to the infant during use of the convertible seat 100.

In an embodiment, the location of at least one fastening means 105 on the strap members 104 may be selected to facilitate easy access to the user, while also retaining strength properties of the strap members 104.

In an embodiment, the backrest member 102 may be mounted to the seat member 101 via hinges (not shown). In an alternate embodiment, the backrest member 102 may also be mounted to the seat member 101, via means such as but not limited to stitching, seaming, or any other means, which enable pivotal movement between the seat mode 114 and the diaper changing station mode 404 of the backrest member 102 with respect to the seat member 101.

In an embodiment, at least one of the seat member 101 and the backrest member 102 may be operated by the user as per user's preference, for example, converting the convertible seat 100 to the seat mode 114 or the diaper changing station mode 404.

In an embodiment, the convertible seat 100 may also include a handle 108, provided at free ends of at least one of the seat member 101 and the backrest member 102, so that the user may carry the convertible seat 100 after use. In an exemplary embodiment, the handle 108 includes a first handle 108*a* secured to the seat member 101 and a second handle 108*b* secured to the backrest member 102 (e.g., shown in FIG. 4B). The first handle 108*a* and the second handle 108*b* are located such that, they align themselves upon folding of the convertible seat 100, for ease of transport.

In an embodiment, the seat member 101 and the backrest member 102 may be made of flexible materials, such as but not limited to propylene plastic or a thermoplastic polymer or any other material which may allow the user to compactly fold the convertible seat 100 for ease of transport.

In an embodiment, the shoulder strap 107 may be attached to the handle 108, for ease of carrying the convertible seat 100 (for e.g. as shown in FIG. 7C). In another embodiment, the shoulder strap 107 may be attached to free ends of either of the seat member 101 or the backrest member 102 while maintaining the portability of the convertible seat 100. The shoulder strap 107 may be attached to free ends by using conventional methods, such as but not limited to stitching, seaming, or any other means.

In an embodiment, the securing means 109 is selected from a group such as but not limited to a snap-fit arrangement, a Velcro, a zipper and the like, which serves the purpose.

In an embodiment, the attaching means 110 may be the snap-fit arrangement, the Velcro, the zipper and the like, which serves the purpose.

In an embodiment, the convertible seat 100 may include a locking means provided on outer surface of the backrest member 102 and the seat member 101. The locking means may be operated by the user once the convertible seat 100 is in the folded position 702. The locking means 1102 is adapted to maintain the folded position 702 of the convertible seat 100, so that the contents are safe within during the transport. In an embodiment, the folded position 702 can be referred to as a first level fold'. Further, the convertible seat 100 can also be folded along axis A-A' (shown in FIGS. 10 and 11A) to assume a 'second level fold' (see, 1104) as shown in FIG. 11B. It should be appreciated by those ordinarily skilled in the art that seam (1106) provided along substantially central portion of the compartment 103*b* aids in achieving the second level fold 1104 for the convertible seat 100. The locking means 1102 may be a two part design, wherein a first part 1102*a* is attached to one side of the backrest member 102 and a second part 1102*b* is attached to other side of the backrest member 102. In the second level fold 1104, the first part 1102*a* can be secured with the second part 1102*b* thereby holding the convertible seat 100 in the second level fold 1104. The locking means 1102 may have a Velcro™, a snap fit arrangement, or the like.

In an embodiment, the convertible seat 100 in the diaper changing station mode 404 may be adapted to be used on a floor.

Advantages

In an embodiment of the present disclosure a convertible seat is provided, that can be used as a seat as well as a diaper changing station.

In an embodiment, the convertible seat eliminates the need of carrying multiple bags while traveling, due to inclusion of the storage compartments. The storage compartments are adapted to store items such as but not limiting to baby products and domestic items, thereby mitigating the need of carrying additional bags.

In an embodiment, the convertible seat in the diaper changing station mode also provides a sterile environment while attending to infants or toddlers.

In an embodiment, the convertible seat is also made from flexible material which ensures light weight construction, ease of handling and transportation.

In an embodiment, the convertible seat enables the user, such as a parent or a caretaker, to play on the floor with the baby with more comfort and enjoyment, and/or feed a baby in a supported position.

Although the invention has been described with reference to specific exemplary embodiments, it is noted that various modifications and changes may be made to these embodiments without departing from the broad spirit and scope of the invention.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omissions and substitutions of equivalents are contemplated as circumstances may suggest or render expedient, but such are intended to cover the application or implementation without departing from the spirit or scope of the invention.

What is claimed is:

1. A convertible seat, comprising:

a seat member;

a backrest member pivotally mounted to the seat member and configured to at least assume a folded position, a first unfolded position and a second unfolded position, wherein the first unfolded position is a seat mode and the backrest member in the seat mode is inclined relative to the seat member to enable an adult accompanying an infant to sit, and wherein the second unfolded position is a diaper changing station mode and the backrest member in the diaper changing station mode is aligned with a longitudinal plane of the seat member to enable an infant to rest for replacement of a diaper; and a plurality of storage compartments configured on at least one of the seat member and the backrest member for storing baby products and domestic items, wherein a compartment of the plurality of compartments is configured with a sterile surface, the compartment when laid-out on the seat member and the backrest member in the diaper changing station mode allows the infant to rest on the sterile surface for replacement of the diaper.

2. The seat as claimed in claim 1 further comprising one or more strap members, each of the one or more strap members having first end secured to the backrest member and a second end secured to the seat member, wherein each of the one or more strap members is adapted to maintain position of the seat member and the backrest member suitably, when the backrest member is in either of the seat mode and the diaper changing station mode.

3. The seat as claimed in claim 2, further comprising a fastening member configured to each of the one or more strap members, the fastening member configured to enable the user to adjust each of the one or more strap members for the backrest member to assume the seat mode and the diaper changing station mode.

4. The seat as claimed in claim 3, wherein each of the one or more strap members is configured with a first segment and a second segment, the first segment coupled to a male engagement member of the fastening member and the second segment coupled to a female engagement member of the fastening member, the male engagement member coupled with the female engagement member for enabling the backrest member to assume the seat mode; and the male engagement member disconnected with the female engagement member for enabling the backrest member to assume the diaper changing station mode.

5. The seat as claimed in claim 1, wherein each of the one or more strap members is configured to assume an extended position and a retracted position, such that, in the retracted position, each of the one or more strap members is foldable, thereby configuring the convertible seat to be in either the folded position and the diaper changing station mode; and in the extended position, each of the one or more strap members maintains position of the backrest member relative to the seat member, thereby configuring the convertible seat in the seat mode.

6. The seat as claimed in claim 1, wherein the compartment is configured to store diapers and wipes and is mounted on the backrest member such that the compartment is flipped out for accessing the diaper therein.

7. The seat as claimed in claim 1, further comprising a handle configured to at least one of the seat member and the backrest member, the handle configured to enable the adult to carry the convertible seat.

8. The seat as claimed in claim 1, further comprising a shoulder strap configured to at least one of the seat member and the backrest member, the shoulder strap configured to enable the adult to carry the convertible seat.

9. The seat as claimed in claim 1, further comprising a securing means configured to each compartment of the plurality of compartments, the securing means configured to secure contents within each compartment of the plurality of compartments, wherein the securing means are unfastened to access the contents therein.

10. The seat as claimed in claim 1, further comprising a seam along at least one compartment configured on the backrest member to aid in folding the convertible seat to a second level fold from the folded position, the folded position being a first level fold, and wherein the seat further comprises a locking means attached to the backrest member for securing the convertible seat is in the second level fold.

11. The seat as claimed in claim 1, further comprising a changing pad configured on an interior surface of at least one of the seat member and the backrest member, wherein the changing pad is configured to assume a collapsed position and a deployed position, wherein, the changing pad assumes the deployed position from the collapsed position when the backrest member is in the diaper changing station mode for providing a sterile surface for the infant to rest during replacement of the diaper.

12. The seat as claimed in claim 1, wherein the plurality of compartments are made of fabric for storing the baby products and domestic items.

13. The seat as claimed in claim 1, wherein one compartment of the plurality of compartments made of fabric material and configured to extend from the backrest member and positioned adjacent to one or more strap members, and wherein the compartment is configured with an opening for holding a bottle.

14. A convertible seat, comprising:

a seat member;

a backrest member pivotally mounted to the seat member, and configured to at least assume a folded position, a first unfolded position and a second unfolded position, wherein the first unfolded position is a seat mode, the backrest member in the seat mode is inclined relative to the seat member to enable an adult accompanying an infant to sit, and wherein the second unfolded position is a diaper changing station mode, the backrest member in the diaper changing station mode is aligned with a longitudinal plane of the seat member to enable an infant to rest for replacement of a diaper;

a plurality of storage compartments configured on at least one of the seat member and the backrest member for storing baby products and domestic items, wherein a compartment of the plurality of compartments is configured with a sterile surface, the compartment when laid-out on the seat member and the backrest member in the diaper changing station mode allows the infant to rest on the sterile surface for replacement of the diaper; and a changing pad configured on an interior surface of at least one of the seat member and the backrest member, the changing pad configured to assume a collapsed position and a deployed position, wherein, the changing pad assumes the deployed position from the collapsed position when the backrest member is in the diaper changing station mode for providing a surface for the infant to rest during replacement of the diaper.

15. The seat as claimed in claim 14 further comprising one or more strap members, each of the one or more strap members having a first end secured to the backrest member and the a second end secured to the seat member, wherein each of the one or more strap members is adapted to maintain position of the seat member and the backrest member suitably, when the collapsible seat is in either of the seat mode and the diaper changing station mode.

16. The seat as claimed in claim 15, further comprising a fastening member configured to each of the one or more strap members, the fastening member configured to enable the user to adjust each of the one or more strap member, thereby operating the backrest member between the seat mode and the diaper changing station mode.

17. The seat as claimed in claim 16, wherein each of the one or more strap members is configured with a first segment and a second segment, the first segment coupled to a male engagement member of the fastening member and the second segment coupled to a female engagement member of the fastening member, the male engagement member coupled with the female engagement member for operating the backrest member to the seat mode; and the male engagement member disconnected with the female engagement member for operating the backrest member to the diaper changing station mode.

18. The seat as claimed in claim 15, wherein each of the one or more strap members is configured to assume an extended position and a retracted position, such that, the retracted position, each of the one or more strap members is foldable, thereby configuring the convertible seat to be in either the folded position and the diaper changing station mode; and in the extended position, each of the one or more strap members maintains position of the backrest member relative to the seat member, thereby configuring the convertible seat in the seat mode.

19. The seat as claimed in claim 14, further comprising a compartment of the plurality of compartments made of a fabric material and configured to extend from the backrest member and positioned adjacent to one or more strap members, wherein the compartment is configured with an opening for holding a bottle.

20. A convertible seat, comprising:

a seat member;

a backrest member pivotally mounted to the seat member, and configured to assume a folded condition and a plurality of unfolded positions, the backrest member configured to operate in a seat mode in a first unfolded position of the plurality of unfolded positions and configured to operate in a diaper changing station mode in a second unfolded position of the plurality of unfolded positions, wherein in the seat mode, the backrest member is inclined relative to the seat member to enable an adult accompanying an infant to sit, and wherein in the diaper changing station mode, the backrest member is aligned with a longitudinal plane of the seat member to enable an infant to rest for replacement of a diaper;

a plurality of storage compartments configured on at least one of the seat member and the backrest member for storing baby products and domestic items, wherein a compartment of the plurality of compartments is configured with a sterile surface, the compartment when laid-out on the seat member and the backrest member in the diaper changing station mode allows the infant to rest on the sterile surface for replacement of the diaper; and a changing pad configured on an interior surface of at least one of the seat member and the backrest member, the changing pad configured to assume a collapsed position and a deployed position, wherein, the changing pad assumes the deployed position from the collapsed position when the backrest member is in the diaper changing station mode for providing a surface for the infant to rest during replacement of the diaper; and wherein a compartment of the plurality of compartments is made of a fabric material and configured to extend from the backrest member and positioned adjacent to one or more strap members, wherein the compartment is configured with an opening for holding a bottle.

* * * * *